US006285008B1

(12) United States Patent
Fleetwood et al.

(10) Patent No.: US 6,285,008 B1
(45) Date of Patent: Sep. 4, 2001

(54) IGNITION PLUG AND METHOD OF MANUFACTURE

(75) Inventors: Charles T. Fleetwood, Easley; Michael A. Runge, Piedmont, both of SC (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/481,300

(22) Filed: Jan. 11, 2000

(51) Int. Cl.[7] ..... H01T 13/20
(52) U.S. Cl. ..... 219/270; 313/141
(58) Field of Search ..... 219/270, 544; 123/145 A, 145 R; 313/136, 141

(56) References Cited

U.S. PATENT DOCUMENTS

| | | | |
|---|---|---|---|
| 1,328,147 | 1/1920 | Genn . | |
| 1,363,380 | 12/1920 | Zimmermann et al. . | |
| 1,511,937 | 10/1924 | Bentley . | |
| 1,512,564 | 10/1924 | Rogers . | |
| 1,812,438 | 6/1931 | Hurley . | |
| 1,996,422 | 4/1935 | Hurley . | |
| 2,630,107 | 3/1953 | Field . | |
| 2,874,208 | 2/1959 | Pierce . | |
| 3,229,032 | 1/1966 | Willis . | |
| 5,589,091 * | 12/1996 | Muller | 219/270 |

* cited by examiner

*Primary Examiner*—John A. Jeffery
(74) *Attorney, Agent, or Firm*—Reising, Ethington, Barnes, Kisselle, Learman & McCulloch, P.C.

(57) ABSTRACT

Igniter and spark plugs according to the invention include a tubular insulator having an axially extending passage and axially opposed sealing shoulders within the passage spaced from the ends of the insulator. A multi-part electrode assembly is disposed within the insulator, including an upper electrode joined by resistance welding to a lower electrode. A heat-expandable sleeve is carried about the upper electrode and a lower end thereof confronts a compressible gasket and the upper sealing shoulder. An enlarged head of the lower electrode confronts a sealing gasket on the lower sealing shoulder. During resistance welding, the upper and lower electrodes are displaced toward one another causing the gaskets to be compressed against the sealing shoulders of the insulator to form a gas-tight seal therebetween.

9 Claims, 2 Drawing Sheets

FIG-1
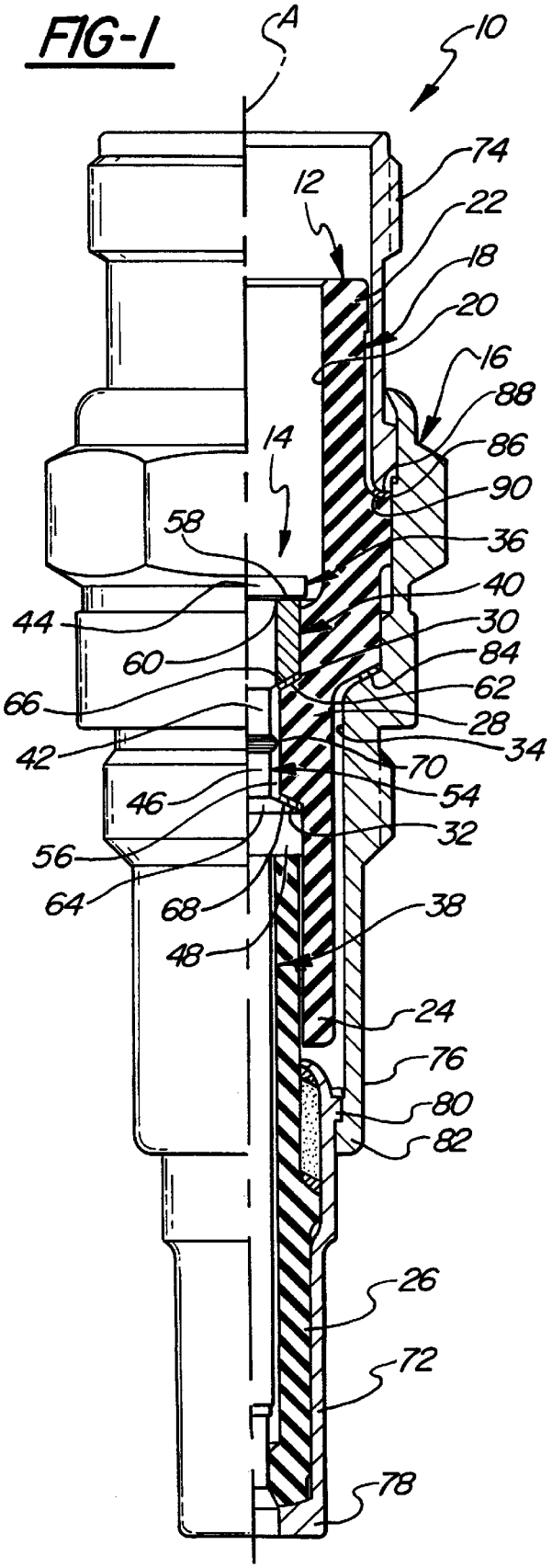
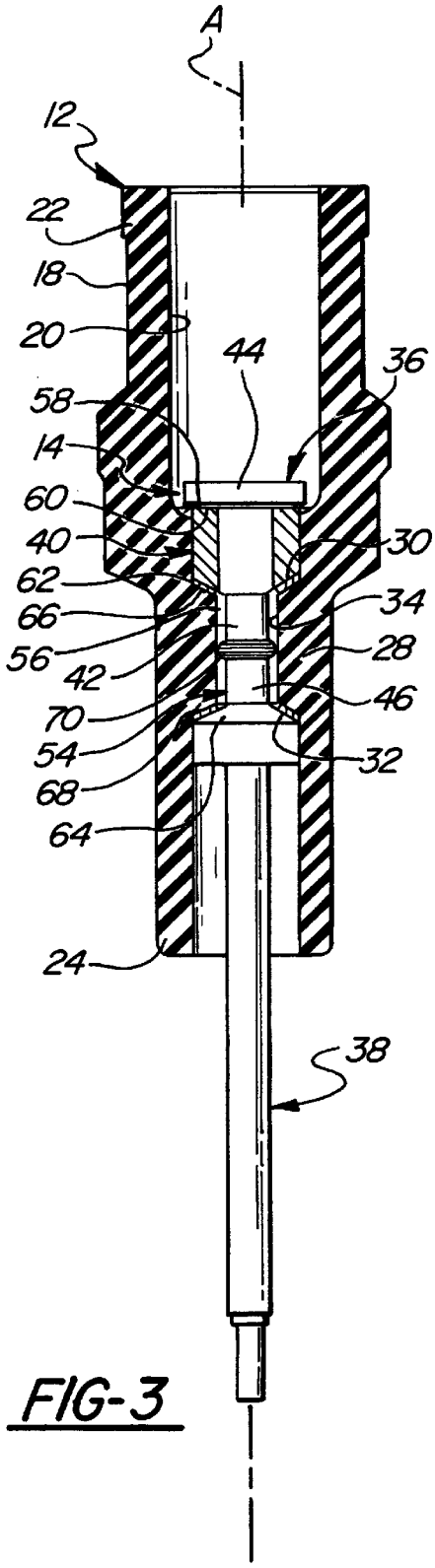
FIG-3

IGNITION PLUG AND METHOD OF MANUFACTURE

BACKGROUND OF THE INVENTION

1. Technical Field

This invention relates to ignition plugs, such as igniter and spark plugs, used in internal combustion engines to ignite the combustion gases in the combustion chamber, and more particularly to the seal provided between the insulator and the electrode which serves to prevent the escape of combustion gases through the plug.

2. Related Prior Art

A hermetic seal is required between the internal electrode and surrounding tubular insulator body of igniter and spark plug devices for preventing high temperature, high pressure combustion gases from passing through the plugs. Some seals are typically made by fusing glass to the adjacent surfaces of the electrode and insulator. The glass fusion process is labor intensive, costly and subjects the components of the plug to elevated temperatures above 1000° F.

The internal electrodes of such plug devices are typically of a multi-part construction. The electrode components, including upper and lower electrodes, are assembled within the insulator in abutting contact across axially opposed electrode surfaces of the components. While applying an axial compressive load to the components, the confronting surfaces are locally heated and melted by resistance welding to fuse the material of the electrode components together across the interface. Resistance welding imparts only localized heating of the electrode components at the weld interface, and avoids subjecting the other components to high temperatures associated with the glass fusion sealing. With resistance welding, the mating electrode components are locally melted and the materials fused together at the interface without the use of any foreign filler metal. Joining techniques such as brazing and soldering employ low melting point filler metals different than that of the electrode materials being joined, which could impair the electrical properties of the electrode.

U.S. Pat. No. 2,874,208 to Pierce discloses an igniter plug having a single piece center electrode formed with an enlarged firing button at its lower end that is external to the surrounding tubular insulator body. A sleeve of heat-expandable metal is disposed about the center electrode and is urged against an interior shoulder of the insulator by a tensioning nut that is either threaded or brazed about the center electrode. A washer is compressed between the firing button and the external end face of the insulator body to provide a gas-tight seal. There is no teaching or suggestion of incorporating such a compressed washer sealing system in ignition plugs having multi-piece electrodes joined by resistance welding.

SUMMARY OF THE INVENTION AND ADVANTAGES

An ignition plug according to the invention used for igniting combustion gases in an internal combustion engine comprises a tubular insulator body having a passage therein extending between axially opposite ends of the insulator. Within the passage are upper and lower sealing shoulders spaced from the ends of the insulator and facing in opposite directions generally axially outwardly toward the ends. A multi-piece electrode assembly is disposed within the passage and includes an upper electrode, a lower electrode aligned axially with an extending end axially prolongation of the upper electrode, and an expansion sleeve disposed about at least one of the electrodes. The upper and lower electrodes have opposed confronting surfaces extending transversely of the axis of the electrodes joined by a resistance weld joint, with the expansion sleeve being joined to one or more electrodes. When so joined, the electrode assembly presents a pair of axially inwardly facing sealing surfaces adjacent the sealing shoulders of the insulator, with one of the sealing surfaces being provided on the expansion sleeve and the other of the sealing surfaces being provided on one of the electrodes.

According to a characterizing feature of the invention, the ignition plug is provided, in addition to the inner shoulders of the insulator and the expansion sleeve, with compressible metal gaskets disposed in constant axial compression between the sealing shoulders of the insulator and the sealing surfaces of the electrode assembly as a result of the joining of the electrodes by the resistance weld joint to provide a gas-tight seal between the electrode assembly and the insulator to prevent the leakage of combustion gases through the ignition plug.

According to a method of the invention for manufacturing such ignition plugs, an insulator is formed with the opposing interior shoulders, and, the sealing washers are disposed against the shoulders, often which a first electrode with expansion sleeve are extended into the insulator from one end thereof and a second electrode is extended into the insulator from the other end such that the electrodes are aligned axially and confront across transversely disposed surfaces. While forcing the electrodes axially into confronting engagement with one another under a compression load so as to place the washers under axial compression, the electrodes are welded or joined together by a resistance weld across their confronting surfaces to permanently maintain the washers under constant axially compression thereby perfecting a gas-tight seal between the multi-part electrode assembly and the surrounding insulator.

The invention has the advantage of utilizing the compressive loading forces normally imparted on the upper and lower electrodes during resistance welding for securing the electrodes together to compress metal sealing gaskets between the multi-piece electrode and insulator to provide a gas-tight seal therebetween, without the need for glass fusion sealing or the introduction of foreign filler materials in the joining of the upper and lower electrodes that could disrupt the electrical properties. In addition, the high thermal expansion sleeve provides an increasing compressive load as operating temperatures increase. This increasing load is unique in that most prior art has decreased sealing capabilities because of the inability of the designs to take advantage of thermal expansion properties of the components.

BRIEF DESCRIPTION OF THE DRAWINGS

These and other features and advantages of the present invention will become more readily appreciated when considered in connection with the following detailed description and drawings wherein:

FIG. 1 is an elevational view, shown partly broken away, of an ignition plug constructed according to a presently preferred embodiment of the invention;

FIG. 3 is a view like FIG. 2, but showing the electrode and insulator in the assembled condition.

DETAILED DESCRIPTION

Figure 2:
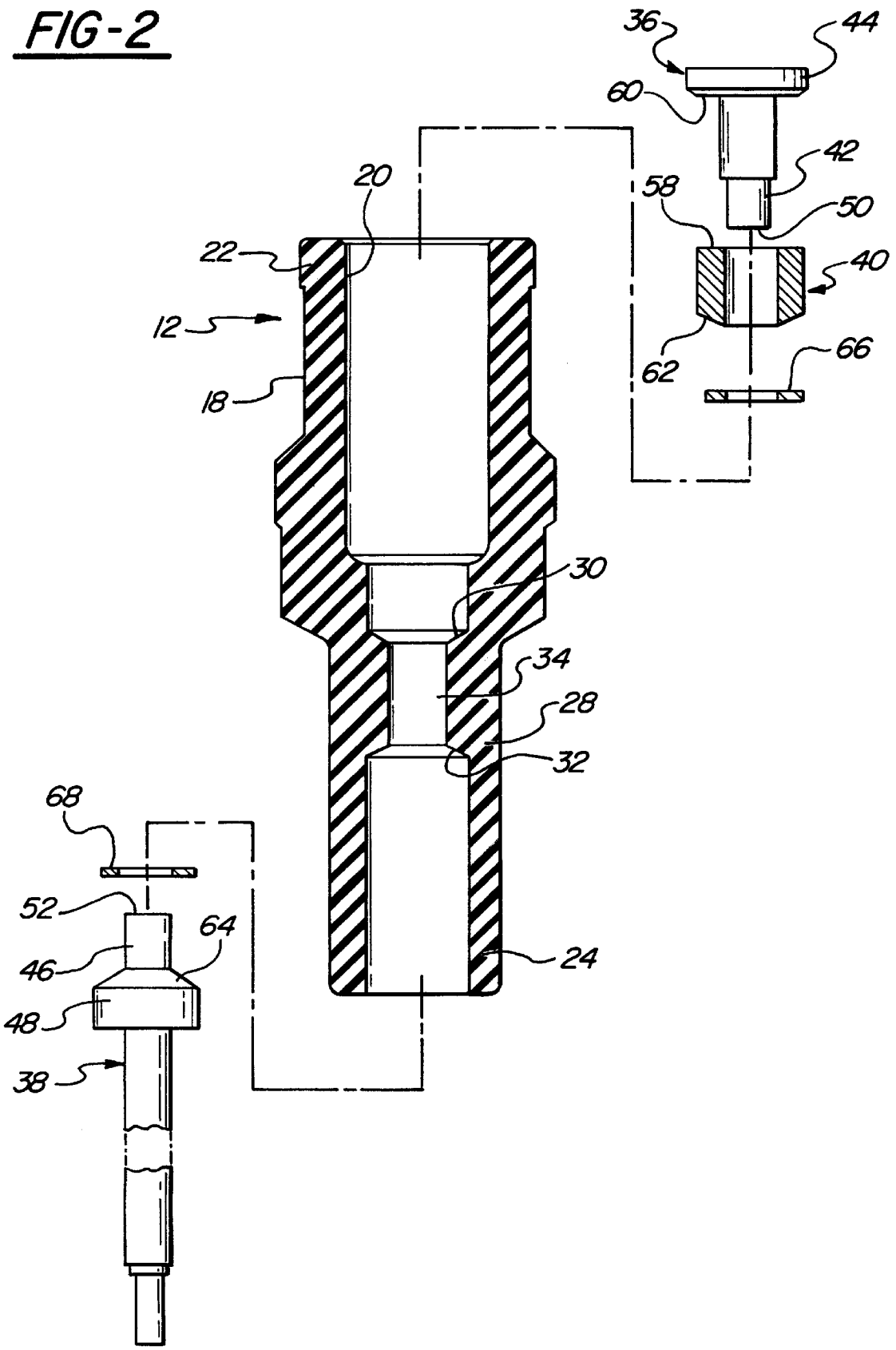
FIG. 2 is an exploded elevation view of the multi-part electrode and insulator components shown in their pre-assembled relationship.

Referring now to the drawings and particularly to FIG. 1, there is shown an ignition plug 10 constructed according to a presently preferred embodiment of the invention which may take the form of an igniter plug or a spark plug used in internal combustion applications for igniting combustion gases within a combustion cylinder (not shown) of an engine.

The plug 10 comprises a tubular insulator generally indicated at 12 within which is disposed a multi-part electrode assembly shown generally at 14 and about which is provided a metal shell generally indicated at 16 encasing the insulator 12.

The insulator 12 has a generally tubular construction and, in the illustrated embodiment, includes an upper section 18 having a bore or passage 20 extending between opposite upper and lower axially ends 22,24 of the section 18. A tubular lower section 26 is formed separately from the upper section 18 and extends therefrom an axial prolongation of the upper section 18.

Within the passage 20 there is provided an annular rib or restriction 28 presenting an upper sealing shoulder 30 spaced axially inwardly from the upper end 22 of the insulator section 18 and oriented transverse to a longitudinal axis A of the passage 20 so as to face generally axially toward the upper end 22 of the insulator section 18. The radially inwardly projecting annular restriction further presents a lower sealing shoulder 32 spaced axially inwardly of the lower end 24 of the insulator section 18, also in transverse relation to the axis A so as to face generally axially toward the lower end 24. By generally axially facing, it is understood that the shoulders 30,32 present a step in the passage 20 that has an axial component (i.e., perpendicular or angled with respect to the axis A) to present an abutment surface for sealing with the electrode assembly 14 as will be described below. In the illustrated example, the annular sealing shoulders 30,32 are inclined with respect to the axis A to present a conical abutment surface set in an angle of about 30° from perpendicular with respect to the axis A. The invention contemplates sealing shoulders 30,32 which are set at the same or different angles with respect to the axis A from an orientation perpendicular to the axis A to angles less than parallel with the axis A.

The annular restriction 28 defines a restricted passage region 34 having a predetermined diameter less than that of the remainder of the passage 20.

The insulator 12 may be fabricated of conventional ceramic materials or the like commonly employed in the ignition plug art.

The electrode assembly 14 is fabricated of multiple parts, including an upper electrode 36 and a lower electrode 38 and an expansion sleeve 40. The upper electrode 36 has a shank 42 that is preferably cylindrical and is formed with a radially enlarged head 44 disposed within the passage 20 between the upper end 22 and upper sealing shoulder 30 of the insulator section 18. The lower electrode 38 also includes a shank 46 that is preferably cylindrical and a radially enlarged cylindrical head 48 disposed between the lower end 24 and lower sealing shoulder 32 of the insulator section 18. The electrodes 36,38 are axially aligned and coextensive and have confronting end faces 50,52 oriented transverse to the longitudinal axis A, and preferably perpendicular thereto. A section 54 of the electrodes 36,38 extends through the restricted passage region 34 and has a diameter less than that of the diameter of the restricted region 34 to define an annular gap 56 therebetween.

The electrodes 36,38 are fabricated of electrically conductive metal which may be of the same or different alloy. The upper electrode 36, for example, may be fabricated of Kovar, and the lower electrode 38 may be fabricated of 836 alloy. Of course, other alloy compositions may be used as electrode materials may also be employed, provided the upper and lower electrode materials are compatible or joined by a resistance welding, as will be described below.

The expansion sleeve 40 is disposed about the shank of one of the electrodes, and preferably the upper shank 42 as illustrated. The sleeve 40 has an upper end 58 that confronts an annular axially inwardly facing abutment surface 60 of the head 44 of the upper electrode 36 and is fixed to the upper electrode by brazing or welding. Alternatively, the sleeve 40 could be formed as an integral piece of the electrode 36 of the same material. An axially opposite lower end of the sleeve 40 defines an annular sealing surface 62 adjacent the upper sealing shoulder 30 of the insulator section 18. As shown, the sealing surface 62 of the sleeve 40 is disposed in axially aligned, interfering relationship with the upper sealing shoulder 30. The enlarged head 48 of the lower electrode 38 presents an axially inwardly facing sealing surface 64 disposed adjacent the lower sealing shoulder 32 in axially aligned, interfering relationship therewith. Angular metal washers or gaskets 66,68 are disposed on the upper and lower sealing shoulders 30,32, respectively, between the shoulders 30,32 and their associated sealing surfaces 62,64. The gaskets 66,68 are preferably fabricated of a compressible metal such as steel or the like and may have an initial shape that is the same as or different than that of the shape of the sealing shoulder on which it is disposed (i.e., either planer or conical having the same or different angular orientation with respect to a plane normal to the axis A when in the unstressed condition).

The upper and lower electrodes 36,38 are joined at their interface 50,52 by a resistance weld joint 70 under conditions of compressive loading such that the sealing surfaces 62,64 of the electrode assembly 14 compress and maintain a constant compression load on the gaskets 66,68 urging them into intimate sealing engagement with the upper and lower shoulders 30,32 of the insulator, forming a mechanical gas-tight hermetic seal between the electrode assembly 14 and the insulator 12 thereby preventing any combustion gases from escaping the combustion chamber through the passage 20 of the ignition plug 10. The resistance welding causes the electrode materials at the end faces 50,52 to locally melt and then meld and fuse together at the interface of the electrodes providing the weld joint 70 that is of the same material as that of the individual electrode components and is essentially unchanged apart from localized alloying of the materials and localized changes in hardness and microstructure resulting from the welding. The weld joint 70 is free of any foreign filler materials, as might be used in brazing or soldering, that may present a sudden material change at the interface and disrupt the flow of current between the electrodes at the interface. It will be appreciated that the resistance welding process contains the heat very local to the interface of the electrodes 36,38 such that the upper and lower electrodes are generally unaffected, as are they sleeve 40 and insulator 12 from the welding process.

As a result of the compressive loads during welding, the weld joint 70 may bulge radially outwardly of the section 54, with the gap 56 being provided to accommodate such expansion at the weld joint to prevent interference with the insulator 12.

In practice, the electrode assembly 14 is joined with the insulator 12 by disposing the sleeve 40 about the upper electrode 36 and extending it into the passage 20 together with the upper gasket 66 through the upper end 22 of the insulator 12, and extending the lower electrode 38 together with the lower gasket 68 into the passage 20 through the lower end 24 thereof. A load is applied to the electrodes 36,38 to urge them with force axially toward one another bringing the end faces 50,52 into forced confronting engagement with one another. Sufficient resistance is introduced at the interface to locally melt the end faces 50,52 while applying continued compressive loading, urging the electrodes 36,38 further toward one another to compress the gaskets tightly against the sealing shoulders 30,32 of the insulator to develop the hermetic seal. The resultant weld joint 70 which secures the electrodes 30,32 together and maintains constant compressive loading on the gaskets 66,68.

The expansion sleeve 40 is preferably fabricated of a heat-expandable material, such as Hastelloy-X which, upon heating, expands axially, further compressing the gaskets 66,68 under high temperature conditions to maintain the integrity of the seal during severe operating conditions.

Following the union of the electrode assembly 14 with the upper insulator section 18, the lower insulator section 26 is slid onto the shank 46 of the lower electrode 38 and the shell 16 disposed about the insulator 12 in conventional manner. As shown, the shell 16 may be fabricated of several parts which are mechanically clamped about the insulator 12 to provide a protective, gas-tight metal covering about the insulator 12. In the illustrated embodiment, the shell 16 includes a lower section 72, an upper section 74, and a middle section 76. The lower section 72 has an end flange 78 extending over the end of the lower section 26 of the insulator 12, and a locking rib 80 adjacent its upper end which is engaged by a cooperating flange 82 of the middle shell section 76. A sealing gasket 84 is provided between opposing shoulders of the middle shell section 76 and insulator 12 which is compressed during installation of the shell 16 to provide a gas-tight seal between the shell 16 and insulator 12. Another gasket 86 is provided between the insulator 12 and upper shell sections 74. The gasket 86 is compressed to provide a seal upon deforming an upper flange 88 of the middle shell section 76 about a cooperating shoulder 90 of the upper shell section 74 to thereby place the shell assembly 16 in a constant state of axially compression about the insulator 12.

The lower insulator section 26 confronts the under side of the head 48 of the lower electrode 38 and is urged upon axially compression of the shell 16 during its installation against the head 48, assisting and maintaining a constant compressive load on the inner sealing gasket 68.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. An igniter construction for igniting combustion gases in an internal combustion engine comprising:

a tubular insulator having axially opposite ends and a passage therein extending between said ends;

said insulator having upper and lower sealing shoulders provided within said passage spaced axially inwardly from said ends of said insulator and facing generally axially outwardly toward said ends;

a multi-part electrode assembly disposed within said passage including an upper electrode, a lower electrode, and an expansion sleeve;

a resistance weld joint securing said upper electrode to said lower electrode with said expansion sleeve being captured on said electrodes presenting a pair of axially spaced, axially inwardly facing sealing surfaces on said electrode assembly adjacent said sealing shoulders of said insulator, with one of said sealing surfaces being provided on said expansion sleeve and the other of said sealing surfaces being provided on one of said electrodes; and upper and lower sealing gaskets disposed in constant axial compression between said sealing shoulders of said insulator and said sealing surfaces of said electrode assembly as a result of the joining of said electrodes by said resistance weld joint to provide a gas-tight seal between said electrode assembly and said insulator to prevent the leakage of combustion gases therebetween.

2. The construction of claim 1 wherein said sealing gaskets are fabricated of metal.

3. The construction of claim 1 wherein said upper electrode has an axially extending shank and an enlarged head provided at an upper end of said shank, and said expansion sleeve is disposed about said shank having an upper end thereof confronting said head of said upper electrode and a lower end presenting one of said sealing surfaces.

4. The construction of claim 1 wherein said expansion sleeve is fabricated of a high thermal expansion material.

5. The construction of claim 1 wherein said one of said electrodes includes an enlarged head having one of said sealing surfaces provided thereon disposed in axially opposed relation to an associated one of said sealing shoulders of said insulator, and the other of said sealing surfaces is provided on an axially inward end of said expansion sleeve.

6. The construction of claim 1 wherein said weld joint being provided at confronting surfaces of said upper and lower electrodes.

7. A method of sealing a multi-part electrode assembly of an igniter plug within a passage of a surrounding insulator to provide a fluid-tight seal there between, said method including:

providing a pair of sealing shoulders on said insulator within said passage in spaced relation to axially opposite ends of said insulator;

disposing a pair of sealing washers against said sealing shoulders of said insulator;

disposing an expansion sleeve of the multi-part electrode assembly about a first electrode of the assembly and extending said sleeve and said first electrode into said passage from one end thereof such that an end sealing surface of said expansion sleeve confronts one of said sealing washers;

disposing a second electrode of the assembly into the passage such that said second electrode confronts the other washer;

forcing said electrodes axially into confronting engagement with one another placing the washers in axial compression; and while supporting the confronting electrodes in axial compression, joining the electrodes together by a resistance weld to permanently maintain the washers under axial compression thereby perfecting a fluid-tight seal between the electrode assembly and the insulator.

8. The method of claim 7 including fabricating the expansion sleeve of high expansion material.

9. An igniter construction for igniting combustion gases in an internal combustion engine comprising:

a tubular insulator having axially opposite ends and a passage therein extending between said ends;

said insulator having upper and lower sealing shoulders provided within said passage spaced axially inwardly from said ends of said insulator and facing generally axially outwardly toward said ends;

a multi-part electrode assembly disposed within said passage including an upper electrode having a sealing surface and a lower electrode having a sealing surface;

a resistance weld joint securing said upper electrode to said lower electrode disposing said sealing surfaces of said electrodes in axially spaced, axially inwardly facing relation adjacent said sealing shoulders of said insulator; and upper and lower sealing gaskets disposed in constant axial compression between said sealing shoulders of said insulator and said sealing surfaces of said electrode assembly as a result of the joining of said electrodes by said resistance weld joint to provide a gas-tight seal between said electrode assembly and said insulator to prevent the leakage of combustion gases therebetween.

* * * * *